US006862567B1

(12) United States Patent
Gao

(10) Patent No.: US 6,862,567 B1
(45) Date of Patent: Mar. 1, 2005

(54) NOISE SUPPRESSION IN THE FREQUENCY DOMAIN BY ADJUSTING GAIN ACCORDING TO VOICING PARAMETERS

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 882 days.

(21) Appl. No.: 09/651,476

(22) Filed: Aug. 30, 2000

(51) Int. Cl.[7] ..... G10L 21/02; G10L 19/14
(52) U.S. Cl. ..... 704/228; 704/225
(58) Field of Search ..... 704/225, 226, 704/210, 207, 256; 381/94.3; 342/159; 416/134 A; 455/232.1

(56) References Cited

U.S. PATENT DOCUMENTS 4,135,159 A * 1/1979 Kubanoff ..... 455/232.1
4,135,856 A * 1/1979 McGuire ..... 416/134 A
4,532,648 A * 7/1985 Noso et al. ..... 704/226
4,628,529 A * 12/1986 Borth et al. ..... 704/226
5,812,970 A * 9/1998 Chan et al. ..... 704/226
5,937,377 A 8/1999 Hardiman et al.
5,940,025 A * 8/1999 Koehnke et al. ..... 342/159
5,956,678 A * 9/1999 Hab-Umbach et al. ..... 704/256

* cited by examiner

*Primary Examiner*—Vijay Chawan
*Assistant Examiner*—Daniel A Nolan
(74) *Attorney, Agent, or Firm*—Farjami & Farjami LLP

(57) ABSTRACT

An input signal enters a noise suppression system in a time domain and is converted to a frequency domain. The noise suppression system then estimates a signal to noise ratio of the frequency domain signal. Next, a signal gain is calculated based on the estimated signal to noise ratio and a voicing parameter. The voicing parameter may be determined based on the frequency domain signal or may be determined based on a signal ahead of the frequency domain signal with respect to time. In that event, the voicing parameter is fed back to the noise suppression system, for example, by a speech coder, to calculate the signal gain. After calculating the gain, the noise suppression system modifies the signal using the calculated gain to enhance the signal quality. The modified signal may further be converted from the frequency domain back to the time domain for speech coding.

20 Claims, 6 Drawing Sheets

```
/* Normal update logic */
update_flag = FALSE
if ( u(m) ≤ UPDATE_THLD ) {
    update_flag = TRUE
    update_cnt = 0
}

/* Forced update logic */
else if (( E_tot(m) > NOISE_FLOOR_DB ) and ( Δ_E(m) < DEV_THLD )) {
    update_cnt = update_cnt + 1
    if ( update_cnt ≥ UPDATE_CNT_THLD )
        update_flag = TRUE
}

/* "Hysteresis" logic to prevent long-term creeping of update_cnt */
if ( update_cnt == last_update_cnt )
    hyster_cnt = hyster_cnt + 1
else
    hyster_cnt = 0
last_update_cnt = update_cnt
if ( hyster_cnt > HYSTER_CNT_THLD )
    update_cnt = 0
```

FIG. 1b
(PRIOR ART)

```
/* Set or reset modify flag */
index_cnt = 0
for ( i = N_M to N_c - 1 step 1 ) {
    if ( σ_q(i) ≥ INDEX_THLD )
        index_cnt = index_cnt + 1
}
if ( index_cnt < INDEX_CNT_THLD )
    modify_flag = TRUE
else
    modify_flag = FALSE

/* Modify the SNR indices to get {σ'_q} */
if ( modify_flag == TRUE )
    for ( i = 0 to N_c - 1 step 1 )
        if (( υ(m) ≤ METRIC_THLD ) or (σ_q(i) ≤ SETBACK_THLD ))
            σ'_q(i) = 1
        else
            σ'_q(i) = σ_q(i)
else
    {σ'_q} = {σ_q}


/* Limit {σ''_q} to SNR threshold σ_th */
for ( i = 0 to N_c - 1 step 1 )
    if (σ'_q(i) < σ_th )
        σ''_q(i) = σ_th
    else
        σ''_q(i) = σ'_q(i)
```

FIG. 1c
(PRIOR ART)

NOISE SUPPRESSION IN THE FREQUENCY DOMAIN BY ADJUSTING GAIN ACCORDING TO VOICING PARAMETERS

BACKGROUND OF THE INVENTION

1. Field of the Invention

The present invention is generally in the field of speech coding. In particular, the present invention is in the field of noise suppression for speech coding purposes.

2. Background Art

Today, noise reduction has become the subject of many research projects in various technical fields. In the recent years, due the tremendous demand and growth in the areas of digital telephony, the Internet and cellular telephones, there has been an intense focus on the quality of audio signals, especially reduction of noise in speech 1*d* signals. The goal of an ideal noise suppressor system or method is to reduce the noise level without distorting the speech signal, and in effect, reduce the stress on the listener and increase intelligibility of the speech signal.

Technically, there are many different ways to perform the noise reduction. One noise reduction technique that has gained ground among the experts in the field is a noise reduction system based on the principles of spectral weighting. Spectral weighting means that different spectral regions of the mixed signal of speech and noise are attenuated or modified with different gain factors. The goal is to achieve a speech signal that contains less noise than the original speech signal. At the same time, however, the speech quality must remain substantially intact with a minimal distortion of the original speech. Another important design consideration is that the residual noise, i.e. the noise remaining in the processed signal, must not sound unnatural.

Typically, the spectral weighting technique is performed in the frequency domain using the well-known Fourier transform. To explain the principles of spectral weighting in simple terms, a clean speech signal is denoted with s(k), a noise signal is denoted with n(k), and an original speech signal is denoted with o(k), which may be formulated as o(k)=s(k)+n(k). Now, taking the Fourier transform of this equation leads to O(f)=S(f)+N(f). At this step, the actual spectral weighting may be performed by multiplying the spectrum O(f) with a real weighting function, such as W(f)>=0. As a result, P(f)=W(f) O(f), and the processed signal p(k) is obtained by transforming P(f) back into the time domain. Now, below, a more elaborate system 100, including a conventional noise suppression module 106 is discussed. The conventional noise suppression module 106 of the speech pre-processing system 100 is that of the Telecommunication Industry Association Interim Standard 127 ("IS-127"), which is known as Enhanced Variable Rate Coder ("EVRC"). The IS-127 specification is hereby fully incorporated by reference in the present application.

As stated above, FIG. 1*a* illustrates a conventional speech pre-processing system 100, which includes a noise suppression module 106. After reading and buffering samples of the input speech 101 for a given speech frame, an input speech signal 101 enters the speech preprocessor system 100. The input speech signal 101 samples are then analyzed by a silence enhancement module 102 to determine whether the speech frame is pure silence, in other words, whether only silence noise is present. Next, the silence enhanced input speech signal 103 is scaled down by the high-pass filter module 104 to condition the input speech 101 against excessive lose frequency that degrade the voice quality.

The high-pass filtered speech signal 105 is then routed to a noise suppression module 106. The noise suppression module 106 performs a noise attenuation of the environmental noise in order to improve the estimation of speech parameters.

The noise suppression module 106 performs noise processing in frequency domain by adjusting the level of the frequency response of each frequency band that results in substantial reduction in background noise. The noise suppression module 106 is aimed at improving the signal-to-noise ratio ("SNR") of the input speech signal 101 prior to the speech encoding process. Although the speech frame size is 20 ms, the noise suppression module 106 frame size is 10 ms. Therefore, the following procedures must be executed two times per 20 ms speech frame. For the purpose of the following description, the current 10 ms frame of the high-pass filtered speech signal 105 is denoted m.

As shown, the high-pass filtered speech signal 105, denoted $\{S_{hp}(n)\}$, enters the first stage of the noise suppression module 106, i.e. Frequency Domain Conversion stage 110. At the frequency domain conversion stage 110, $S_{hp}(n)$ is windowed using a smoothed trapezoid window, in which the first D samples of the input frame buffer $\{d(m)\}$ are overlapped from the last D samples of the previous frame, where this overlap is described as: $d(m,n)=d(m-1,L+n)$; $0 \leqq n \leqq D$, where m is the current frame, n is the sample index to the buffer $\{d(m)\}$, L=80 is the frame length, and D=24 is the overlap or delay in samples. The remaining samples of the input buffer $\{d(m)\}$ are then pre-emphasized at the Frequency Domain Conversion stage 110 to increase the high to low frequency ratio with a pre-emphasized factor $\zeta_p=-0.8$ according to the following: $d(m,D+n)=S_{hp}(n)+\zeta_p S_{hp}(n-1)$; $0 \leqq n<L$. This results in the input buffer containing L+D=104 samples in which the first D samples are the pre-emphasized overlap from the previous frame, and the following L samples are pre-emphasized input from the current frame m.

Next, a smoothed trapezoidal window is applied to the input buffer $\{d(m)\}$ to form a Discrete Fourier Transform ("DFT") data buffer $\{g(n)\}$, defined as:

$$g(n)=\begin{cases} d(m,n)\ \sin^2(\pi(n+0.5)/2D); & 0 \le n < D, \\ d(m,n); & D \le n < L, \\ d(m,n)\ \sin^2(\pi(n-L+D+0.5)/2D); & 0 \le n < D, \\ 0; & D+L \le n < M, \end{cases}$$

where M=128 is the DFT sequence length. At this point, a transformation of g(n) to the frequency domain is performed using the DFT to obtain G(k). A transformation age technique, such as a 64-point complex Fast Fourier Transform ("FFT") may be used to convert the time domain data buffer g(n) to the frequency domain data buffer spectrum G(k). Thereafter, G(k) is used to computer noise reduction parameters for the remaining blocks, as explained below.

The frequency domain data buffer spectrum G(k) resulting from the Frequency Domain Conversion stage 110 is used to estimate channel energy $E_{ch}(m)$ for the current frame m at Channel Energy Estimator stage 115. At this stage, the 64-point energy bands are computed from the FFT results of stage 101, and are quantized into 16 bands (or channels). The quantization is used to combine low, mid, and high frequency components and to simplify the internal computation of the algorithm. Also, in order to maintain accuracy, the quantization uses a small step size for low frequency ranges, increased the step size for higher frequencies, and uses the highest step size for the highest frequency ranges.

Next, at Channel SNR Estimator stage 120, quantized 16-channel SNR indices $\sigma_q(i)$ are estimated using the channel energy $E_{ch}(m)$ from the Channel Energy Estimator stage 115, and current channel noise energy estimate $E_n(m)$ from Background Noise Estimator 140 which continuously tracks the input spectrum G(k). In order to avoid undervaluing and overvaluing of the SNR, the final SNR result is also quantized at the Channel SNR Estimator 120. Then, a sum of voice metrics v(m) at Voice Metric Calculation stage 130 is determined based upon the estimated quantized channel SNR indices $\sigma_q(i)$ from the Channel SNR Estimator stage 120. This process involves a transformation of the actual sum of all sixteen signal-to-noise ratios from a predetermined voice metric table with the quantized channel SNR indices $\sigma_q(i)$. The higher the SNR, the higher the voice metric sum v(m). Because the value of the voice metric v(m) is also quantized, the maximum and the minimum values are always ascertainable.

Thereafter, at Spectral Deviation Estimator stage 125, changes from speech to noise and vice versa are detected which can be used to indicate the presence of speech activity of a noise frame. In particular, a log power spectrum $E_{db}(m,i)$ is estimated based upon the estimated channel energy $E_{ch}(m)$, from the Channel Energy Estimator stage 115, for each of the sixteen channels. Then, an estimated spectral deviation $\Delta_E(m)$ between a current frame power spectrum $E_{db}(m)$ and an average long-term power spectral estimate $E_{db}(m)$ is determined. The estimated spectral deviation $\Delta_E(m)$ is simply a sum of the difference between the current frame power spectrum $E_{db}(m)$ and the average long-term power spectral estimate $E_{db}(m)$ at each of the sixteen channels. In addition, a total channel energy estimate $E_{tot}(m)$ for the current frame is determined by taking the logarithm of the sum of the estimated channel energy $E_{ch}(m)$ at each frame. Thereafter, an exponential windowing factor $\alpha(m)$ as a function of the total channel energy $E_{tot}(m)$ is determined, and the result of that determination is limited to a range determined by a predetermined upper and lower limits $\alpha_H$ and $\alpha_L$, respectively. Then, an average long-term power spectral estimate for the subsequent frame $E_{db}(m+1,i)$ is updated using the exponential windowing factor $\Delta(m)$, the log power spectrum $E_{db}(m)$, and the average long-term power spectral estimate for the current frame $E_{db}(m)$.

With the above variables determined at the Spectral Deviation Estimator stage 125, noise estimate is updated at Noise Update Decision stage 135. At this stage 135, a noise frame indicator update_flag indicating the presence of a noise frame can be determined by utilizing the voice metrics v(m) from the Voice Metric Calculation stage 130, and the total channel energy $E_{tot}(m)$ and the spectral deviation $\Delta_E(m)$ from the Spectral Deviation Estimator stage 125. Using these three pre-computed values coupled with a simple delay decision mechanism, the noise frame indicator update_flag is ascertained. The delay decision is implemented using counters and a hysterisis process to avoid any sudden changes in the noise to non-noise frame detection. The pseudo-code demonstrating the logic for updating the noise estimate is set forth in the above-incorporated IS-127 specification and shown in FIG. 1*b*.

Now, having updated the background noise at the Noise Update Decision stage 135, at Channel Gain Calculation stage 150, it is determined whether channel SNR modification is necessary and whether to modify the appropriate channel SNR indices $\sigma_q(i)$. In some instances, it is necessary to modify the SNR value to avoid classifying a noise frame as speech. This error may stem from distorted frequency spectrum. By analyzing the mid and high frequency bands at Channel SNR Modifier stage 145, the pre-computed SNR can be modified if it is determined that a high probability of error exists in the processed signal. This process is set forth in the above-incorporated IS-127 specification, as shown in FIG. 1*c*.

Referring to FIG. 1*c*, the quantized channel SNR indices $\sigma_q(i)$ determined at the Channel SNR Estimator 120 are verified to be greater or equal to a predetermined channel SNR index threshold level, i.e. INDEX_THLD, which is set at 12. Thereafter, if it is determined that the index counter is less than a predetermined index counter threshold level (INDEX_CNT_THLD=5), a channel SNR modification flag may be set to indicate that the channel SNR must be modified and the channel SNR indices $\sigma_q(i)$ are modified to obtain modified channel SNR indices $\sigma_q(i)$ or the channel SNR modification flag may be reset to indicate that the modification is not necessary, and the modified channel SNR indices $\sigma_q(i)$ are not changed from the original values $\sigma'_q(i)=\sigma_q(i)$.

Now, if the voice metric sum v(m) determined at the Voice Metric Calculation stage 130 is determined to be less than or equal to a predetermined metric threshold level, i.e. METRIC_THLD=45, or if the channel SNR indices $\sigma_q(i)$ are less than or equal to a predetermined setback threshold level, i.e. SETBACK_THLD=12, the modified channel SNR indices $\sigma'_q(i)$ are set to one. Else, the modified channel SNR indices $\sigma'_q(i)$ are not changed from the original values $\sigma'_q(i)=\sigma_q(i)$. In the following segment, in order to limit the modified channel SNR indices $\sigma_q(i)$ to an SNR threshold level $\sigma_{th}$, it is first determined whether the modified channel SNR indices $\sigma'_q(i)$ are less than the SNR threshold level $\sigma_{th}$. If so, the threshold limited and modified channel SNR $\sigma''_q(i)$ indices are set to the threshold level $\sigma_{th}$, i.e. $(\sigma''_q(i)=\sigma_{th})$. Else, the SNR indices $\sigma''_q(i)$ are not changed, i.e., $\sigma''_q(i)=\sigma'_q(i)$.

Turning back to FIG. 1*a*, the threshold limited, modified channel SNR indices $\sigma''_q(i)$ are provided to the Channel Gain Calculation stage 150 to determine an overall gain factor $\gamma_n$ for the current frame based upon a pre-set minimum overall gain $\gamma_{min}$ a noise floor energy $E_{floor}$, and the estimated noise spectrum of the previous frame $E_n(m-1)$. Next, the channel gain in the db domain, i.e. $\gamma_{db}(i)$, is determined based on the following equation:

$$\gamma_{db}(i)=\mu_g(\sigma''_q(i)-\sigma_{th})+\gamma_n;0\leqq i<N_c$$

where the gain slope $\mu_g$ is constant factor, set to 0.39. In the following stage, the channel gain $\gamma_{db}(i)$ is converted from the db domain to linear channel gains, i.e. $\gamma_{ch}(i)$, by taking the inverse logarithm of base 10, i.e. $\gamma_{ch}(i)=\min\{1, 10^{\gamma_{db}(i)/20}\}$. Therefore, for a given channel, $\gamma_{ch}$ has a value less than or equal to one, but greater than zero, i.e. $0<\gamma_{ch}(i)\leqq 1$. The gain $\gamma_{ch}$ should be higher or closer to 1.0 to preserve the speech quality for strong voiced areas and, on the other hand, the gain $\gamma_{ch}$ should be lower or closer to zero to suppress noise in noisy areas. Next, the linear channel gains $\gamma_{ch}(i)$ are applied to the G(k) signal by a gain modifier 155 producing a noise-reduced signal spectrum H(k). Finally, H(k) signal is converted back into time domain at Time Domain Conversion stage 160 resulting in noise reduced signal S'(n) in the time domain.

The above-described conventional approach, however, is a simplistic approach to noise suppression, which only considers one dynamic parameter, i.e. the dynamic change in the SNR value, in determining the channel gains $Y_{ch}(i)$. This simplistic approach introduces various downfalls, which may in turn cause a degradation in the perceptual quality of the voice signal that is more audible than the noise signal.

The shortcomings and inaccuracies of the conventional system 100, which are due to its sole reliance on the SNR value, stem from the facts that the SNR calculation is merely an estimation of the noise to signal, and that the SNR value is only an average, which by definition may be more or less than the true SNR value for specific areas of each channel. As a result of its mere reliance on the SNR value, the conventional approach suffers from improperly altering the voiced areas of the speech, and thus, causes degradation in the voice quality.

Accordingly, there is an intense need in the art for a new and improved approach to noise suppression that can overcome the shortcomings in the conventional approach and produce a noise-reduced speech signal with a superior voice quality.

SUMMARY OF THE INVENTION

In accordance with the purpose of the present invention as broadly described herein, there is provided method and system for suppressing noise to enhance signal quality.

According to one aspect of the present invention, an input signal enters a noise suppression system in a time domain and is converted to a frequency domain. The noise suppression system then estimates a signal to noise ratio of the frequency domain signal. Next, a signal gain is calculated based on the estimated signal to noise ratio and a voicing parameter. In one aspect of the present invention, the voicing parameter may be determined based on the frequency domain signal.

In another aspect, the voicing parameter may be determined based on a signal ahead of the frequency domain signal with respect to time. In that event, the voicing parameter is fed back to the noise suppression system to calculate the signal gain.

After calculating the gain, the noise suppression system modifies the signal using the gain to enhance the signal quality. In one aspect, the modified signal may be converted from the frequency domain to time domain for speech coding.

In one aspect, the voicing parameter may be a speech classification. In another aspect, the voicing parameter may be a signal pitch information. Yet, the voicing parameter may be a combination of several speech parameters or a plurality of parameters may be used for calculating the gain. In yet another aspect, the voicing parameter(s) may be determined by a speech coder.

In one aspect of the present invention, the signal gain may be calculated based on $\gamma_{db}=\mu_g(\sigma''_q-\sigma_{th})+\gamma_n$, such that $\mu_g$ is adjusted according to the voicing parameter(s). In other aspects, the voicing parameter(s) may be used to adjust other parameters in the above-shown equation, such as $\sigma_{th}$ or $\gamma_n$, or elements of any other equation used for noise suppression purposes.

Other aspects of the present invention will become apparent with further reference to the drawings and specification, which follow.

BRIEF DESCRIPTION OF THE DRAWINGS

The features and advantages of the present invention will become more readily apparent to those ordinarily skilled in the art after reviewing the following detailed description and accompanying drawings, wherein:

FIG. 1*b* illustrates a conventional pseudo-code for implementing the Noise Update Decision module of FIG. 1*a;*

FIG. 1*c* illustrates a conventional pseudo-code for implementing the Channel SNR Modifier module of FIG. 1*a;*

DETAILED DESCRIPTION OF THE INVENTION

The present invention discloses an improved noise suppression system and method. The following description contains specific information pertaining to the Extended Code Excited Linear Prediction Technique ("eX-CELP"). However, one skilled in the art will recognize that the present invention may be practiced in conjunction with various speech coding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain in brevity, other embodiments of the invention which use the principles of the present invention are not specifically described in the present application and are not specifically illustrated by the present drawings.

Figure 1A:
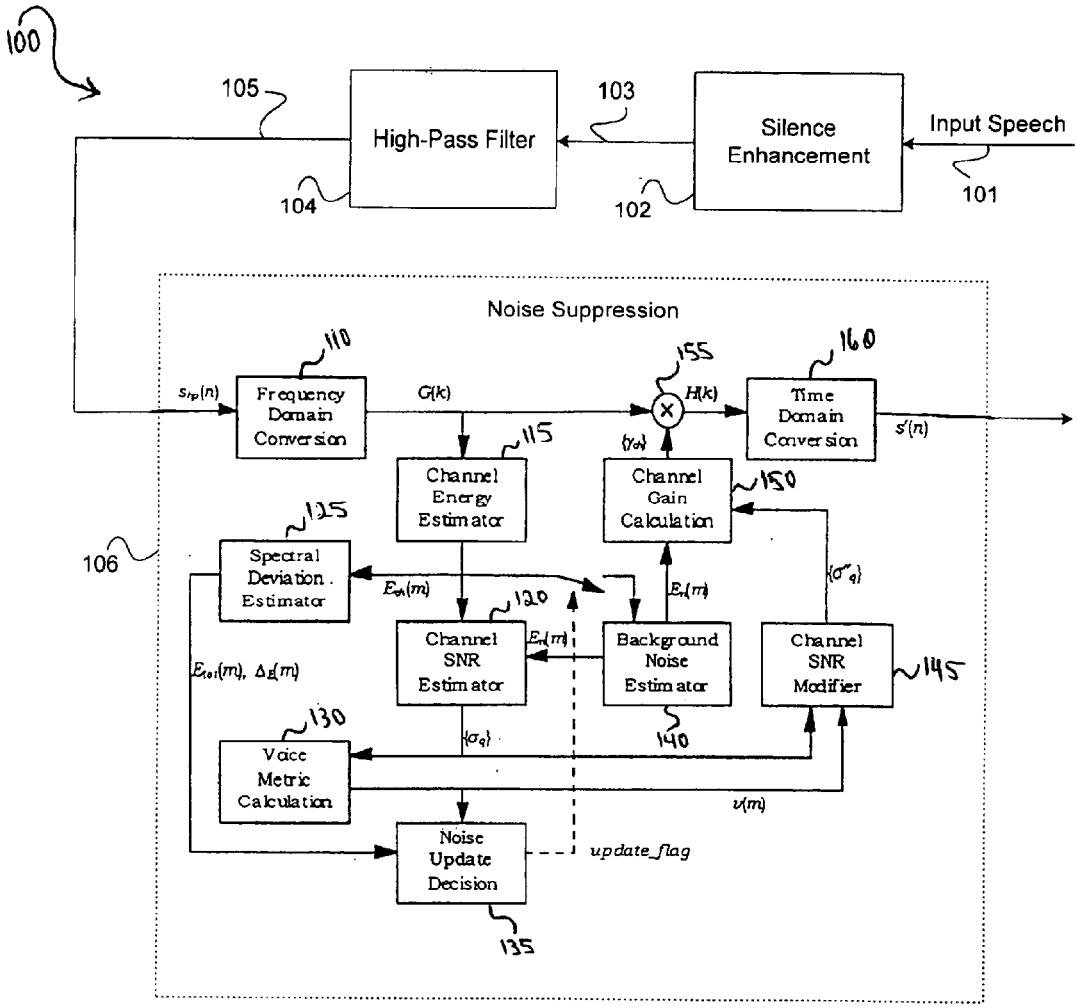
FIG. 1a (PRIOR ART)
FIG. 1*a* illustrates a conventional speech pre-processing system.
Figure 2:
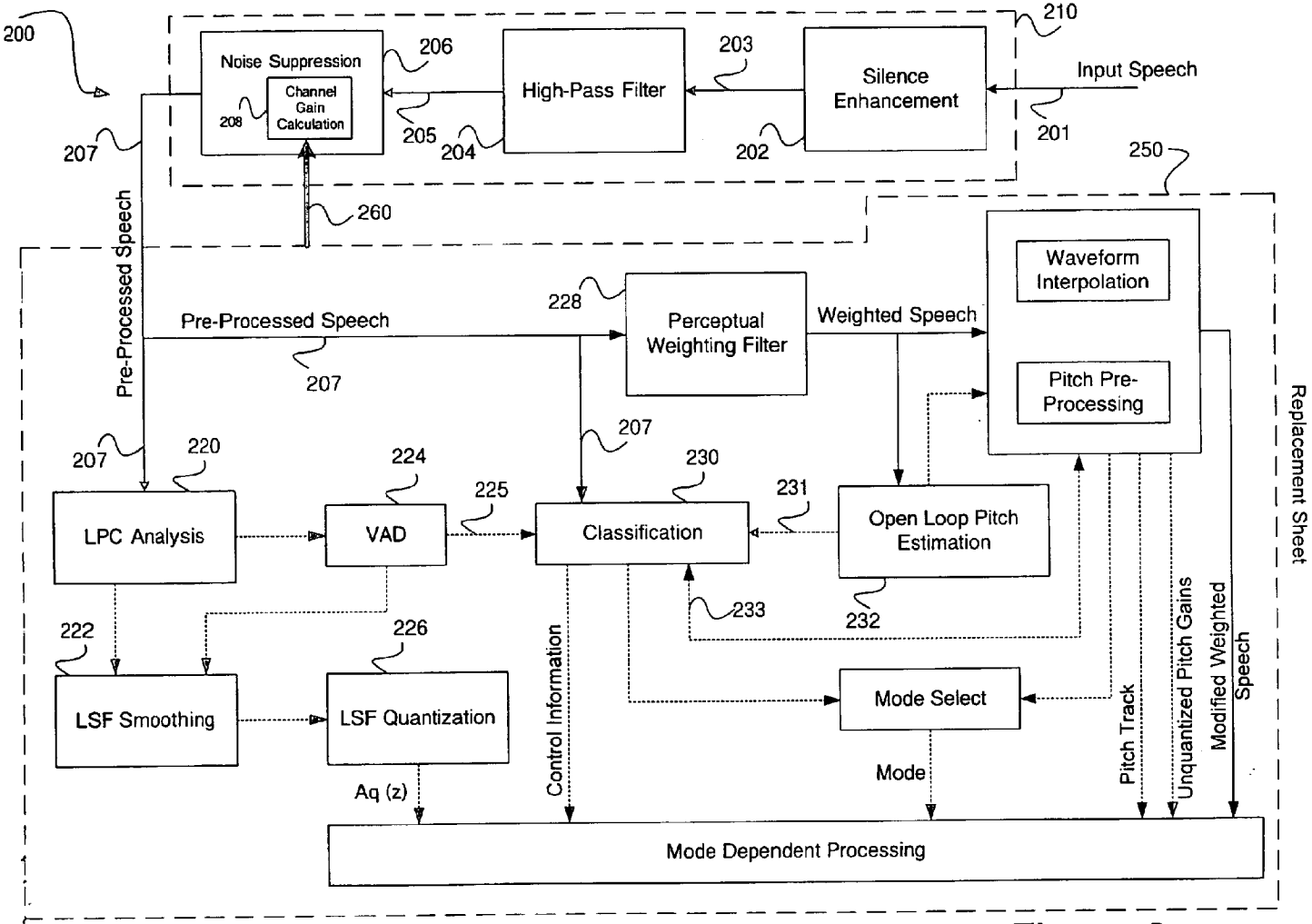
FIG. 2 illustrates a speech processing system according to one embodiment of the present invention.

FIG. 2 illustrates a block diagram of an example encoder 200 capable of embodying the present invention. As shown, the encoder 200 is divided into a speech pre-processor block 210 and a speech processor block 250. First, an input speech signal 201 enters the speech pre-processor block 210. After reading and buffering samples of the input speech 201 for a given speech frame, the input speech signal 201 samples are analyzed by a silence enhancement module 202 to determine whether the speech frame is pure silence, in other words, whether only silence noise is present.

The silence enhancement module 202 adaptively tracks the minimum resolution and levels of the signal around zero. According to such tracking information, the silence enhancement module 202 adaptively detects, on a frame-by-frame basis, whether the current frame is silence and whether the component is purely silence noise. If the silence enhancement module 202 detects silence noise, the silence enhancement module 202 ramps the input speech signal 201 to the zero-level of the input speech signal 201. Otherwise, the input speech signal 201 is not modified. It should be noted that the zero-level level of the input speech signal 201 may depend on the processing prior to reaching the encoder 200. In general, the silence enhancement module 202 modifies the signal if the sample values for a given frame are within two quantization levels of the zero-level.

In short, the silence enhancement module 202 cleans up the silence parts of the input speech signal 201 for very low noise levels and, therefore, enhances the perceptual quality of the input speech signal 201. The effect of the silence enhancement module 202 becomes especially noticeable when the input signal 201 originates from an A-law source or, in other words, the input signal 201 has passed through A-law encoding and decoding immediately prior to reaching the encoder 200.

Continuing with FIG. 2, the silence enhanced input speech signal 203 is then passed through a high-pass filter module 204 of a $2^{nd}$ order pole-zero with a cut-off frequency of 240 Hz. The silence enhanced input speech signal 203 is scaled down by a factor of two by the high-pass filter module 204 that is defined by the following transfer function.

$$H(z) = \frac{0.92727435 - 1.8544941z^{-1} + 0.92727435z^{-2}}{1 - 1.9059465z^{-1} + 0.9114024z^{-2}}$$

The high-pass filtered speech signal 205 is then routed to a noise suppression module 206. At this point, the noise suppression module 206 attenuates the speech signal in order to provide the listener with a clear sensation of the environment. As shown in FIG. 2, the noise suppression module 206, including a channel gain calculation module 208 receives a number of voicing parameters from the speech processor block 250 via a voicing parameter feedback path 260. The voicing parameters include various speech signal parameters, such as speech classification, pitch information, or any other parameters that are calculated by the speech processor block 250 while processing the input speech signal 201. The voicing parameters are then fed back into channel gain calculation module 208 of the noise suppression module 201 to compute the gain $\{\gamma_{ch}(i)\}$, so as to improve the speech quality. This process is discussed in more details below.

Next, as the pre-processed speech signal 207 emerges from the speech pre-processor block 210, the speech processor block 250 starts the coding process of the pre-processed speech signal 207 at 20 ms intervals. At this stage, for each speech frame several parameters are extracted from the pre-processed speech signal 207. Some parameters, such as spectrum and initial pitch estimate parameters may later be used in the coding scheme. However, other parameters, such as maximal sample in a frame, zero crossing rates, LPC gain or signal sharpness parameters may only be used for classification and rate determination purposes.

As further shown in FIG. 2, the pre-processed speech signal 207 enters a linear predictive coding ("LPC") analysis module 220. A linear predictor is used to estimate the value of the next sample of a signal, based upon a linear combination of the most recent sample values. At the LPC analysis module 220, a $10^{th}$ order LPC analysis is performed three times for each frame using three different-shape windows. The LPC analyses are centered and performed at the middle third, the last third and the look-ahead of each speech frame. The LPC analysis for the look-ahead is recycled for the next frame as the LPC analysis is centered at the first third of each frame. Accordingly, for each speech frame, four sets of LPC parameters are available.

A symmetric Hamming window is used for the LPC analyses of the middle and last third of the frame, and an asymmetric Hamming window is used for the LPC analysis of the look-ahead in order to center the weight appropriately. For each of the windowed segments the $10^{th}$ order, auto-correlation is calculated according to $$r(k) = \sum_{n=k}^{N-t} s_w(n) \cdot s_w(n-k),$$

where $s_w(n)$ is the speech signal after weighting with the proper Hamming window.

Bandwidth expansion of 60 Hz and a white noise correction factor of 1.0001, i.e. adding a noise floor of −40 dB, are applied by weighting the auto-correlation coefficients according to $r_w(k)=w(k)\cdot r(k)$, where the weighting function is given by $$w(k) = \begin{cases} 1.0001 & k = 0 \\ \exp\left[-\frac{1}{2}\left(\frac{2\pi \cdot 60 \cdot k}{8000}\right)\right] & k = 1, 2, \ldots, 10 \end{cases}.$$

Based on the weighted auto-correlation coefficients, the short-term LP filter coefficients, i.e.

$$A(z) = 1 - \sum_{i=1}^{10} a_i \cdot z^{-i},$$

are estimated using the Leroux-Gueguen algorithm, and the line spectrum frequency ("LSF") parameters are derived from the polynomial A(z). The three sets of LSFs are denoted $lsf_j(k)$, k=1,2. . . ,10, where $lsf_2(k)$, $lsf_3(k)$, and $lsf_4(k)$ are the LSFs for the middle third, last third and look-ahead of each frame, respectively.

Next, at the LSF smoothing module 222, the LSFs are smoothed to reduce unwanted fluctuations in the spectral envelope of the LPC synthesis filter (not shown) in the LPC analysis module 220. The smoothing process is controlled by the information received from the voice activity detection ("VAD") module 224 and the evolution of the spectral envelope. The VAD module 224 performs the voice activity detection algorithm for the encoder 200 in order to gather information on the characteristics of the input a speech signal 201. In fact, the information gathered by the VAD module 224 is used to control several functions of the encoder 200, such as estimation of signal to noise ratio ("SNR"), pitch estimation, classification, spectral smoothing, energy smoothing and gain normalization. Further, the voice activity detection algorithm of the VAD module 224 may be based on parameters such as the absolute maximum of frame, reflection coefficients, prediction error, LSF vector, the $10^{th}$ order auto-correlation, recent pitch lags and recent pitch gains.

Continuing with FIG. 2, an LSF quantization module 226 is responsible for quantizing the $10^{th}$ order LPC model given by the smoothed LSFs, described above, in the LSF domain. A three-stage switched MA predictive vector quantization scheme may be used to quantize the ten (10) dimensional LSF vector. The input LSF vector (unquantized vector) originates from the LPC analysis centered at the last third of the frame. The error criterion of the quantization is a WMSE (Weighted Mean Squared Error) measure, where the weighting is a function of the LPC magnitude spectrum. The objective of the quantization is set forth as $$\{1\hat{s}f_n(1), 1\hat{s}f_n(1), \ldots, 1\hat{s}f_n(10)\} = arg\ \min\left\{\sum_{k=1}^{10} w_i \cdot (1sf_n(k) - 1\hat{s}f_n(k))^2\right\},$$

where the weighting is $w_i=|P(lsf_n(i))|^{0.4}$, where $|P(f)|$ is the LPC power spectrum at frequency f, the index n denotes the frame number. The quantized LSFs $l\hat{s}f_n(k)$ of the current frame are based on a $4^{th}$ order MA predcition and is given by $l\hat{s}f_n=\tilde{l}sf_n+\hat{\underline{\Delta}}_n^{lsf}$, where $\tilde{l}sf_n$ is the predicted LSFs of the current frame (a function of $\{\hat{\underline{\Delta}}_{n-1}^{lsf}, \hat{\underline{\Delta}}_{n-2}^{lsf}, \hat{\underline{\Delta}}_{n-3}^{lsf}, \hat{\underline{\Delta}}_{n-4}^{lsf}\}$), and $\hat{\underline{\Delta}}_n^{lsf}$ is the quantized prediction error at the current frame. The prediction error is given by $\underline{\Delta}_n^{lsf}=lsf_n-\tilde{l}sf_n$. In one embodiment, the prediction error from the $4^{th}$ order MA prediction is quantized with three ten (10) dimensional codebooks of sizes 7 bits, 7 bits, and 6 bits, respectively. The remaining bit is used to specify either of two sets of predictor coefficients, where the weaker predictor improves or reduces error propagation during channel errors. The prediction matrix is fully populated. In other words, prediction in both time and frequency is applied. Closed loop delayed decision is used to select the predictor and the final entry from each stage based on a subset of candidates. The number of candidates from each stage is ten (10), resulting in the future consideration of 10, 10 and 1 candidates after the $1^{st}$, $2^{nd}$, and $3^{rd}$ codebook, respectively.

After reconstruction of the quantized LSF vector as described above, the ordering property is checked. If two or more pairs are flipped, the LSF vector is declared erased, and instead, the LSF vector is reconstructed using the frame erasure concealment of the decoder. This facilitates the addition of an error check at the decoder, based on the LSF ordering while maintaining bit-exactness between encoder and decoder during error free conditions. This encoder-decoder synchronized LSF erasure concealment improves performance during error conditions while not degrading performance in error free conditions. Moreover, a minimum spacing of 50 Hz between adjacent LSF coefficients is enforced.

As shown in FIG. 2, the pre-processed speech 207 further passes through a perceptual weighting filter module 228. According to one embodiment of the present invention, the perceptual weighting filter module 228 includes a pole zero filter and an adaptive low pass filter. The traditional pole-zero filter is derived from the unquantized LPC filter given by:

$$W_1(z) = \frac{A(z/\gamma_1)}{A(z/\gamma_2)},$$

where $\gamma_1$=0.9 and $\gamma_2$=0.55. The pole-zero filter is primarily used for the adaptive and fixed codebook searches and gain quantization.

The adaptive low-pass filter of the module 228, however, is given by $$W_2(z) = \frac{1}{1-\eta z^{-1}},$$

where $\eta$ is a function of the tilt of the spectrum or the first reflection coefficient of the LPC analysis. The adaptive low-pass filter is primarily used for the open loop pitch estimation, the waveform interpolation and the pitch pre-processing.

Referring to FIG. 2, the encoder 200 further classifies the pre-processed speech signal 207. The classification module 230 is used to emphasize the perceptually important features during encoding. According to one embodiment, the three main frame-based classifications are detection of unvoiced noise-like speech, a six-grade signal characteristic classification, and a six-grade classification to control the pitch pre-processing. The detection of unvoiced noise-like speech is primarily used for generating a pitch pre-processing. In one embodiment, the classification module 230 classifies each frame into one of six classes according to the dominating feature of that frame. The classes are: (1) Silence/Background Noise, (2) Noise-Like Unvoiced Speech, (3) Unvoiced, (4) Onset, (5) Non-Stationary Voiced and (6) Stationary Voiced. In some embodiments, the classification module 230 does not initially distinguish between non-stationary and stationary voiced of classes 5 and 6, and instead, this distinction is performed during the pitch pre-processing, where additional information is available to the encoder 200. As shown, the input parameters to the classification module 230 are the pre-processed speech signal 207, a pitch lag 231, a correlation 233 of the second half of each frame and the VAD information 225.

Turning to FIG. 2, it is shown that the pitch lag 231 is estimated by an open loop pitch estimation module 232. For each 20 ms frame, the open loop pitch lag has to be estimated for the first half and the second half of the frame. These estimations may be used for searching an adaptive code-book or for an interpolated pitch track for the pitch pre-processing. The open loop pitch estimation is based on the weighted speech given by $s_w(z)=s(z)\cdot W_1(z)W_2(z)$, where S(z) is the pre-processed speech signal 207. Two sets of open loop pitch lags and pitch correlation coefficients are estimated per frame. The first set is centered at the second half of the frame and the second set is centered at the first half frame of the subsequent frame, i.e. the look-ahead frame. The set centered at the look-ahead portion is recycled for the subsequent frame and used as a set centered at the first half of the frame. Accordingly, for each frame, there are three sets of pitch lags and pitch correlation coefficients available to the encoder 200 at the computational expense of only two sets, i.e., the sets centered at the second half of the frame and at the look-ahead. Each of these two sets is calculated according to the following normalized correlation function:

$$R(k) = \frac{\sum_{n=0}^{L} S_w(n)\cdot S_w(n-k)}{E},$$

where L=80 is the window size, and $$E = \sum_{n=0}^{L} S_w(n)^2$$

is the energy of the segment. The maximum of the normalized correlation R(k) in each of three regions [17,33], [34,67], and [68,127]are determined, which determination results in three candidates for the pitch lag. An initial best candidate from the three candidates is selected based on the normalized correlation, classification information and the history of the pitch lag.

Turning back to the speech pre-processor block 210, as discussed above, the noise suppression module 206 receives various voicing parameters from the speech processor block 250 in order to improve the calculation of the channel gain. The voicing parameters may be derived from various modules within the speech processor block 250, such as a the classification module 230, the pitch estimation module 232, etc. The noise suppression module 206 uses the voicing parameters to adjust the channel gains $\{\gamma ch(i)\}$.

Figure 3:
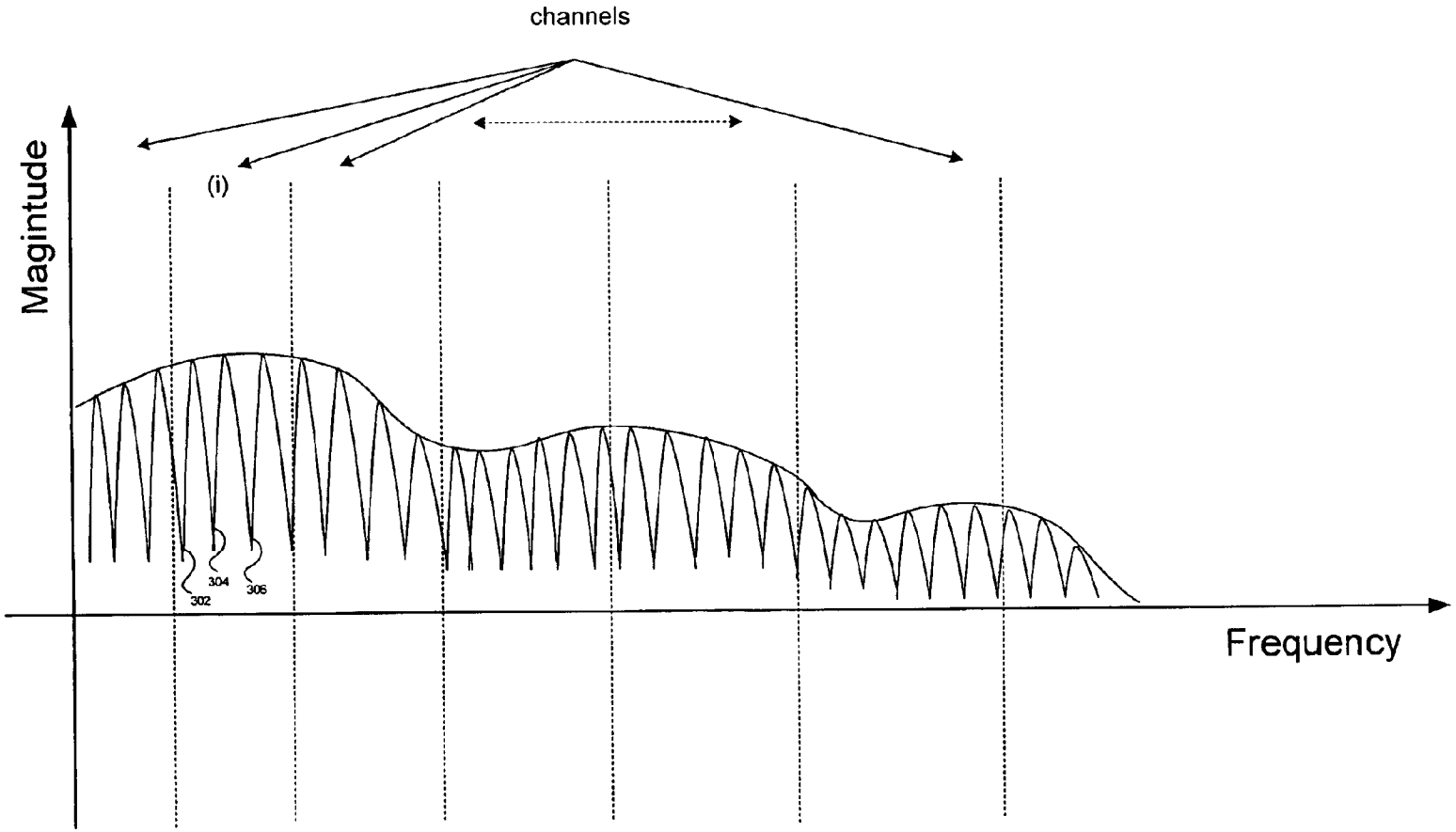
FIG. 3 illustrates voiced, unvoiced and onset areas of a speech signal in time domain.

As explained above, the goal of noise suppression, for a given channel, is to adjust the gain $\gamma_{ch}$ such that it is higher or closer to 1.0 to preserve the speech quality for strong voiced areas and, on the other hand, lowering the gain $\gamma_{ch}$ to be closer to zero for suppressing the noise in noisy areas of speech. Theoretically, for a pure voice signal, the gain $\gamma_{ch}$ should be set to "1.0", so the signal remains. On the other hand, for a pure noise signal, the gain $\gamma_{ch}$ should be set to "0", so the noise signal is suppressed. In between these two theoretical extremes, there lies a spectrum of possible gains $\gamma_{ch}$, where for voice signals, it is desirable to have a gain $\gamma_{ch}$ closer to "1.0" to preserve the speech quality as much as possible. Now, since the speech processor block 250 contributes to cleaning or suppressing some of the noise in the voiced areas, the conventional noise suppression process may be relaxed (as discussed below.) For example, referring to FIG. 3, speech sections 302, 304 and 306 that are located between the harmonics in the voiced area have a very low signal-to-noise ratio and as a result the speech sections 302, 304 and 306 are noisy sections of the voiced area. But, it should be noted that the speech processor block 250 contributes to cleaning the noisy speech areas 302, 304 and 306 by applying pitch enhancement. Accordingly, modification of the speech signal by reducing the gain $\gamma_{ch}$ in such areas may be avoided.

The present invention overcomes the drawbacks of the conventional approaches and improves the gain computation by using other dynamic or voicing parameters, in addition to the SNR parameter used in conventional approaches to noise suppression. In one embodiment of the present invention, the voicing parameters are fed back from the speech processor block 250 into the noise suppression module 206. These voicing parameters belong to previously processed speech frame(s). The advantage of such embodiment is achieving a less complex system, since such embodiment reuses the information gathered by the speech processor block 250. In other embodiments, however, the voicing parameters may be calculated within the noise suppression module 206. In such embodiments, the voicing parameters may belong to the particular speech frame being processed as well as those of the preceding speech frames.

Regardless of whether the voicing parameters are fed back to the noise suppression module 206 or are calculated by the noise suppression module 206, in one embodiment, the channel gain is first calculated in the db domain based on the following equation: $\gamma_{db}(i)=\mu_g(i)(\sigma''_q(i)-\sigma_{th})+\gamma_n$, where the gain slope $\mu_g(i)$ is defined as:

$$\mu_g(i)=\begin{cases}0.39, \text{ if voicing parameters indicate unvoiced speech}\\ 0.39+x, \text{ where } 0<x<0.61, \text{ if voicing parameters indicate voiced speech}\end{cases}$$

Figure 4:
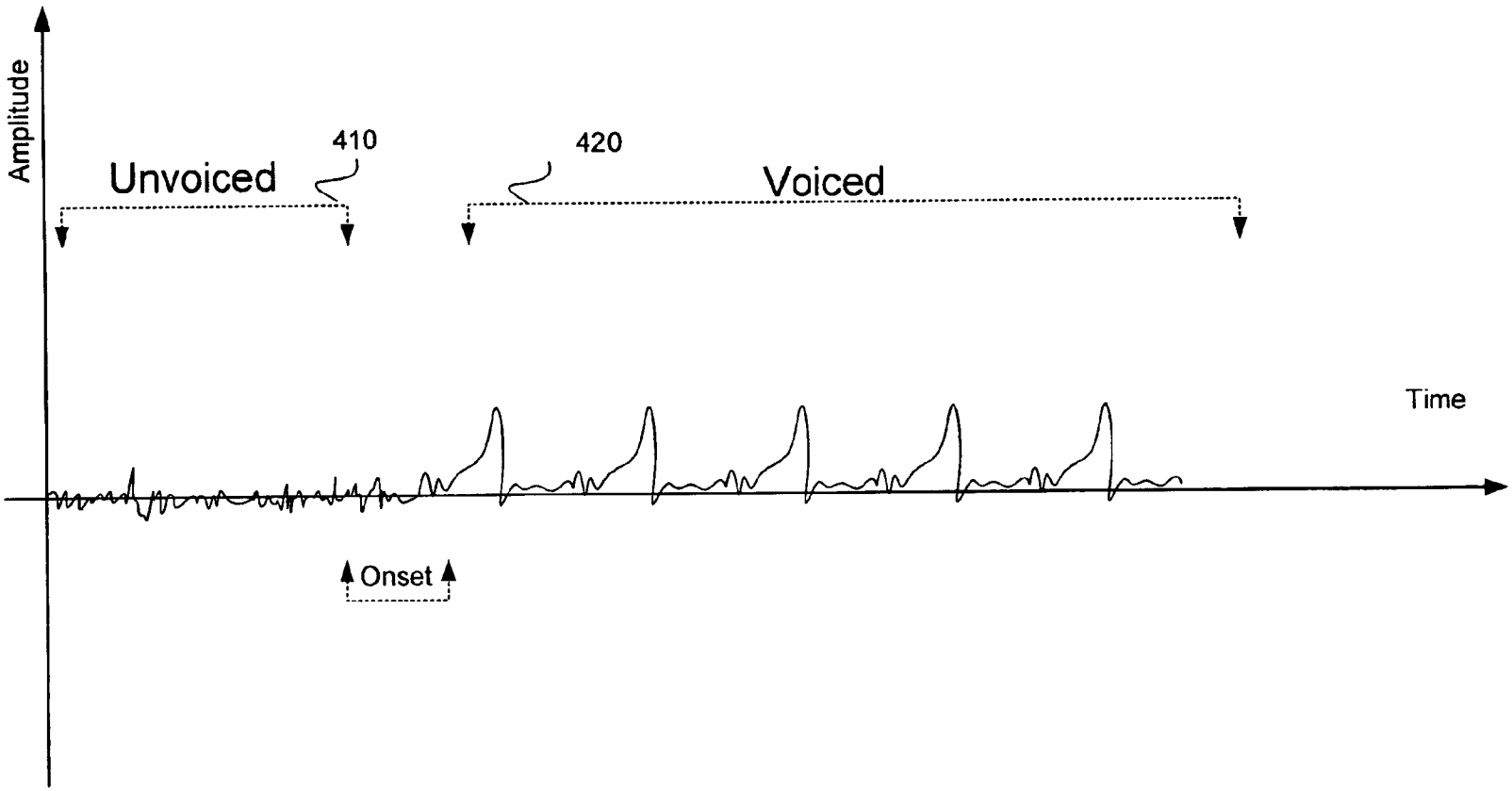
FIG. 4 illustrates a speech signal in frequency domain.

Yet, in other embodiments, the voicing parameters may be used to modify any of the other parameters in the γdb(i) equation, such as γn or σth. Nevertheless, the voicing parameters are used to adjust the gain for each channel through the calculation of the value of "x" by the noise suppression module 206. For example, in one embodiment, the 206 may use the classification parameters from the calculate the adjustment value "x". As explained above, in ication module 230 classifies each speech frame into one of to the dominating features of each frame. With reference to FIG. 4, if the frames is classified to be in the unvoiced area 410, μg(i) will be 0.39. However, if the frames are classified as being in the voiced area 420, μg(i) will 0.39+x, and "x" may be adjusted based on the strength of the voice signal. For example, if the voice signal is classified as stationary voiced, the value of "x" will be higher, but for non-stationary voiced classification, the value of "x" will be less.

In addition to the classification parameter, one embodiment may also consider the pitch correlation R(k). For example, in the voiced area 420, if the pitch correlation value is higher than average, the value of "x" will be increased, and as a result the value of $\mu_g(i)$ is increased and the speech signal G(k) is less modified. Furthermore, an additional factor to consider may be the value of $\mu_g(i-1)$, since the value of $\mu_g(i)$ should not be dramatically different than the value of its preceding $\mu_g$.

The present invention may be embodied in other specific forms without departing from its spirit or essential characteristics. The described embodiments are to be considered in all respects only as illustrative and not restrictive. For example, the voicing parameters that are calculated in the speech processing block 250 may be used or considered in a variety of ways and methods by the noise suppression module 206 and the present invention is not limited to using the voicing parameters to adjust the value of some parameters, such $\mu_g$, $\gamma_n$ or $\sigma_{th}$. The scope of the invention is, therefore, indicated by the appended claims rather than the foregoing description. All changes which come within the meaning and range of equivalency of the claims are to be embraced within their scope.

What is claimed is:

1. A method of suppressing noise in a signal, said method comprising the steps of:

estimating a signal to noise ratio for said signal;

classifying said signal to a classification;

calculating a gain for said signal using said signal to noise ratio and said classification; and modifying said signal using said gain;

wherein said calculating step calculates said gain based on $\gamma_{dh}=\mu_g(\sigma''_q-\sigma_{th})-\gamma_n$, wherein $\mu_g$ is adjusted according to said classification, and wherein $\gamma_{dh}$ is a gain in a db domain, $\mu_g$ is a gain slope, $\sigma''_q$ is a modified signal-to-noise ratio, $\sigma_{th}$ is a threshold level, and $\gamma_n$ is an overall gain factor.

2. The method of claim 1 further comprising a step of estimating a pitch correlation for said signal, wherein said calculating step further uses said pitch correlation.

3. The method of claim 1, wherein said signal is one channel of a plurality of channels of a speech signal.

4. The method of claim 2, wherein $\mu_g$ is further adjusted according to said pitch correlation.

5. The method of claim 1, wherein said signal is in a time domain, and said method further comprises a step of converting said signal from said time domain to a frequency time prior to said estimating step.

6. The method of claim 1, wherein said signal is in a frequency domain, and said method further comprising a step of converting said signal from said frequency domain to a time domain after said modifying step.

7. A method of suppressing noise in a signal having a first signal portion and a second signal portion, wherein said first signal portion is a look-ahead signal of said second signal portion, said method comprising the steps of:

computing a voicing parameter using said first signal portion;

estimating a signal to noise ratio for said second signal portion;

calculating a gain for said second signal portion using said signal to noise ratio and said voicing parameter; and modifying said signal using said gain;

wherein said calculating step calculates said gain based on $\gamma_{db}=\mu_g(\sigma''_q-\sigma_{th})+\gamma_n$, wherein $\mu_g$ is adjusted according to said voicing parameter, and wherein $\gamma_{dh}$ is a gain in a db domain, $\mu_g$ is a gain slope, $\sigma''_q$ is a modified signal-to-noise ratio, $\sigma_{th}$ is a threshold level, and $\gamma_n$ is an overall gain factor.

8. The method of claim 7, wherein said voicing parameter is computed by a speech coder.

9. The method of claim 7, wherein said voicing parameter is a speech classification of said first signal portion.

10. The method of claim 7, wherein said voicing parameter is a pitch correlation of said first signal portion.

11. The method of claim 7, wherein said signal is in a time domain, and said method further comprises a step of converting said signal from said time domain to a frequency time prior to said estimating step.

12. The method of claim 7, wherein said signal is in a frequency domain, and said method further comprising a step of converting said signal from said frequency domain to a time domain after said modifying step.

13. A noise suppression system comprising:

a signal to noise ratio estimator;

a signal classifier;

a signal gain calculator; and a signal modifier;

wherein said estimator estimates a signal to noise ratio of said signal, said signal is given a classification using said signal classifier, said signal gain is calculated based on said signal to noise ratio and said classification using said calculator, and wherein said signal modifier modifies said signal by applying said gain; and wherein said calculator calculates said gain based on $\gamma_{db}=\mu_g(\sigma''_q-\sigma_{th})+\gamma_n$, wherein $\mu_g$ is adjusted according to said classification, and wherein $\gamma_{db}$ is a gain in a db domain, $\mu_g$ is a gain slope, $\sigma''_q$ is a modified signal-to-noise ratio, $\sigma_{th}$ is a threshold level, and $\gamma_n$ is an overall gain factor.

14. The system of claim 13 further comprising a signal pitch estimator for estimating a pitch correlation of said signal for use by said gain calculator.

15. The system of claim 13 further comprising a frequency-to-time converter to convert said signal from a frequency domain to a time domain.

16. A system capable of suppressing noise in a signal having a first signal portion and a second signal portion, wherein said first signal portion is a look-ahead signal of said second signal portion, said system comprising:

a signal processing module for computing a voicing parameter of said first signal portion;

a signal to noise ratio estimator;

a signal gain calculator; and a signal modifier;

wherein said estimator estimates a signal to noise ratio of said second signal portion, said second signal portion gain is calculated based on said signal to noise ratio and said voicing parameter using said calculator, and wherein said signal modifier modifies said second signal portion by applying said gain; and wherein said signal gain calculator determines said gain based on $\gamma_{db}=\mu_g(\sigma''_q-\sigma_{th})+\gamma_n$, wherein $\mu_g$ is adjusted according to said voicing parameter, and wherein $\mu_{db}$ is a gain in a db domain, $\mu_g$ is a gain slope, $\sigma''_q$ is a modified signal-to-noise ratio, $\sigma_{th}$ is a threshold level, and $\gamma_n$ is an overall gain factor.

17. The system of claim 16, wherein said signal processing module is a speech coder.

18. The system of claim 16, wherein said voicing parameter is a speech classification of said first signal portion.

19. The system of claim 16, wherein said voicing parameter is a pitch correlation of said first signal portion.

20. The system of claim 16 further comprising a frequency-to-time converter to convert said second signal portion of said signal from a frequency domain to a time domain.

* * * * *